United States Patent [19]

Tosches

[11] Patent Number: 4,649,966

[45] Date of Patent: Mar. 17, 1987

[54] METHOD AND APPARATUS FOR CONTROLLING WEFT YARN IN SHUTTLELESS LOOMS

[75] Inventor: Anthony J. Tosches, Greensboro, N.C.

[73] Assignee: Draper Corporation, Greensboro, N.C.

[21] Appl. No.: 779,214

[22] Filed: Sep. 23, 1985

[51] Int. Cl.[4] ..... D03D 47/34

[52] U.S. Cl. ..... 139/450

[58] Field of Search ..... 139/302, 303, 429, 430, 139/444, 450

[56] References Cited

U.S. PATENT DOCUMENTS

| | | | |
|---|---|---|---|
| 3,128,797 | 4/1964 | Valley | 139/302 |
| 3,157,208 | 11/1964 | Juillard | 139/450 |
| 3,431,951 | 3/1969 | Thibault et al. | 139/450 |
| 3,960,186 | 6/1976 | Wheeler | 139/450 |
| 4,458,726 | 7/1984 | Wenig | 139/435 |

FOREIGN PATENT DOCUMENTS

| | | | |
|---|---|---|---|
| 7217620 | 6/1974 | Netherlands | 139/450 |

*Primary Examiner*—Henry S. Jaudon

*Attorney, Agent, or Firm*—Charles R. Rhodes; Judith E. Garmon

[57] ABSTRACT

An improved weft yarn control for shuttleless looms in which, as the loom reed beats the inserted weft yarn toward the fabric fell, the trailing portion of the weft yarn is caused to first move forwardly and upwardly into engagement with a stationary clamping device operated in accordance with a prescribed timed sequence. As the trailing weft yarn portion continues its forward movement, it engages a stationary yarn severing device which severs the trailing weft yarn portion from the inserted portion at or near the edge of the fabric fell. The severed trailing portion is then maintained in the path of the yarn insertion device as it moves inwardly on its next pick, whereupon it is seated therein and the timed clamping device released.

5 Claims, 6 Drawing Figures

METHOD AND APPARATUS FOR CONTROLLING WEFT YARN IN SHUTTLELESS LOOMS

BACKGROUND AND SUMMARY OF THE PRESENT INVENTION

This invention is directed to weft yarn control techniques for shuttleless looms, and more specifically to a method and apparatus for controlling the trailing portion of the weft yarn which, as used herein, is the portion of the weft yarn extending from the fabric fell back to the yarn source at the end of each pick of the yarn carrier. This control includes the severing of the trailing weft yarn portion from the inserted portion and the maintaining of the trailing severed portion in proper position for pickup by the yarn insertion element on the successive pick. The severing and clamping steps are accomplished by a stationary apparatus placed in the path of the trailing weft yarn portion during the beat-up operation.

In the operation of a shuttleless loom, a weft yarn is picked up and carried by a carrier or rapier through the shed formed by the warp yarns. The delivery rapier deposits the leading end of the weft yarn in a similar receiving carrier and returns to its home position. Once the weft yarn is inserted in the shed between the upper and lower warp yarns, the loom reed moves forwardly and beats the inserted weft yarn into the fabric fell. During this "beat-up" operation the trailing portion of the weft yarn (hereinafter sometimes referred to as the "non-inserted weft yarn portion") follows the movement of the loom reed from back to front alongside the edge or selvage of the fabric being formed. At some time between successive movements or "picks" of the rapier, it is necessary both to sever the trailing weft yarn portion from the inserted portion and to position the severed end of the non-inserted portion in proper orientation or alignment for engagement by the rapier during its next pick.

The non-inserted weft yarn portion must be controlled at all times and cannot be severed and merely allowed to dangle. Otherwise, the rapier will not pick up the weft yarn on its next pick. If the severing operation occurs too early in the beat-up operation, the inserted weft yarn may loose the tension thereon prior to the time it is gripped between the upper and lower yarns of the yarn shed resulting in unacceptable fabric. On the other hand, if the weft yarn is not severed until after the beat-up operation is completed, the speed of operation may be adversely affected. Secondly, once the weft yarn is severed, the trailing end must be controlled by some type of clamping or gripping device (often called a "transfer" device) and brought into proper alignment in the path of the rapier, so that it is properly seated during the initial stages of the next pick of the rapier (yarn insertion element).

There have been various attempts known to the inventor of the present invention to control the weft yarn, however, generally they involve some type of complicated mechanism which must be moved quickly from one position to another during or subsequent to the beat-up operation. This results in a more complicated and expensive control or transfer mechanism than is desired. Further, the increased number of movable parts leads to potential reliability problems during successive use. Examples of such movable weft yarn control devices are described in the U.S. Pat. Nos. to Budzyna No. 3,899,008 and to Lucian et al 4,338,971.

In the present invention, the control of the trailing weft yarn portion and the severing thereof are effected by substantially stationary devices in response to the forward movement of the weft yarn by the loom reed during the beat-up operation. At the time of completion of the beat-up operation, the trailing weft yarn portion is already severed and held in proper position for being engaged by the carrier on the next pick. There is no need for a repositioning operation which is costly from the standpoint of lost time and more complex mechanisms. At pick speeds of 350–450 picks per minute, it is important to eliminate any time consuming operations which would tend to increase the operating cycle time.

In the apparatus to be herein described, the entire weft yarn control sequence takes place *during* the beat-up operation. As the loom reed moves forwardly to beat the inserted weft yarn portion into the fabric fell, the non-inserted or trailing portion also moves forwardly alongside the selvage. A first clamping device having a guide surface that lifts the non-inserted weft yarn into a position between a pair of clamping jaws is provided in the path of the trailing weft yarn portion. A flag/proximity switch type timing mechanism then activates a solenoid at the precise moment to cause the clamping jaws to close on the yarn thereunder. Once clamping has been effected and as the movement of the reed continues, the section of the weft yarn portion between the clamping jaws and the selvage continues to move forwardly. A severing device positioned in the path of the aforesaid section engages the weft yarn as it moves forwardly and severs it either by a hot wire or by some type of blade activated by the loom reed.

The weft yarn is thus severed and at this time the severed trailing portion is already under the control of the clamping mechanism. The clamping mechanism and guide surface leading thereinto have been so designed as to position and maintain the severed trailing weft yarn in proper position so that as the yarn insertion element begins its next pick, it engages and seats the leading end of the weft yarn so positioned. This portion of the weft yarn then becomes the leading end for the next pick. At the precise time when the leading end is seated the timing mechanism releases the solenoid and thereby opens the clamping jaws to release the severed end of the weft yarn.

More particularly, the mechanism of the present invention is directed to a unique yarn control apparatus for use in conjunction with shuttleless looms of the type in which a weft yarn is repeatedly inserted into the shed formed by warp yarns at high speeds (350–450 picks per minute). The mechanism is operated responsive to the movement of the loom reed from a first position extending along the path that the inserted weft yarn is initially inserted into the shed forwardly into a second position defined by the fabric fell. The aforementioned clamping device and severing device are stationarily placed in the path of the trailing end of the weft yarn which follows the reed forwardly. As the loom reed moves forwardly, the trailing end of the weft yarn is caused to move up over a guide surface into a stationarily positioned pair of clamping jaws. A timing mechanism activates a solenoid to close the clamping jaws at the prescribed point in time when the weft yarn arrives therebetween. Subsequently, the trailing end of the weft yarn between the clamping device and the edge of the fabric fell is moved further forward into operative engagement with a severing device. The severing device may be either a hot wire (in the case of an all synthetic fabric) or a blade or scissors-type severing device (in the case of natural or blended fibers).

The difference in the control technique of the present invention and known approaches is that here the trailing end of the weft yarn is moved into engagement with a stationary clamping and severing device by the action of the loom reed. Subsequent to the completion of the beat-up operation, there is no mechanism for moving the weft yarn to another position, as the clamped weft yarn trailing end is already properly aligned with and in the path of the weft yarn insertion device, so that it is automatically seated in the carrier on its next pick. At a second prescribed point in time when the weft yarn is seated in the carrier or insertion device, the clamping jaws open responsive to the aforesaid timing mechanism.

It is therefore an object of the present invention to provide an improved weft yarn control mechanism.

It is another object of the present invention to provide an improved weft yarn control mechanism of the type described in which the trailing end of the weft yarn is moved into engagement with a stationary clamp and yarn severing device responsive to the forward movement of the loom reed, and no further positioning or repositioning of the weft yarn is necessary preparatory for the next picking operation.

Other objects and a fuller understanding of the invention will become apparent from reading the following detailed description of a preferred embodiment along with the accompanying drawings in which.

DETAILED DESCRIPTION OF A PREFERRED EMBODIMENT

Figure 2B:
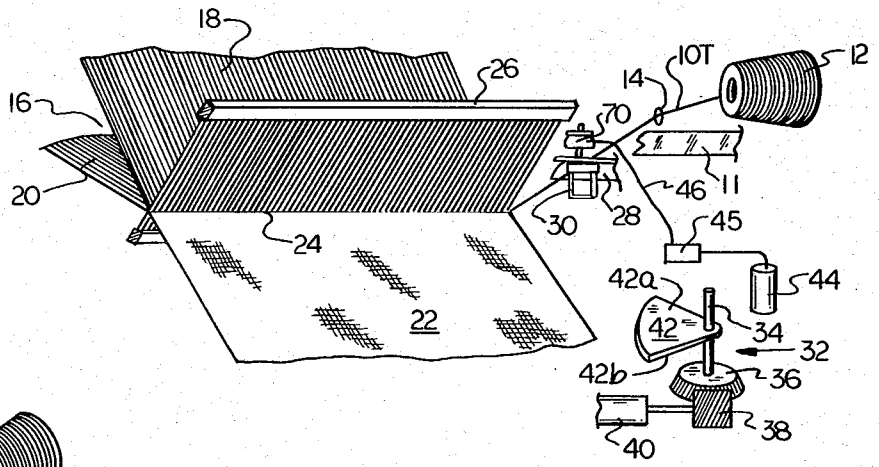
FIG. 2B is a schematic representation similar to FIG. 2A with the reed in its forwardmost position, the inserted yarn portion beaten into the fabric fell and the trailing yarn portion extending past the severing device under the yarn clamp and in position for pick up by the rapier on the next pick.
Figure 1:
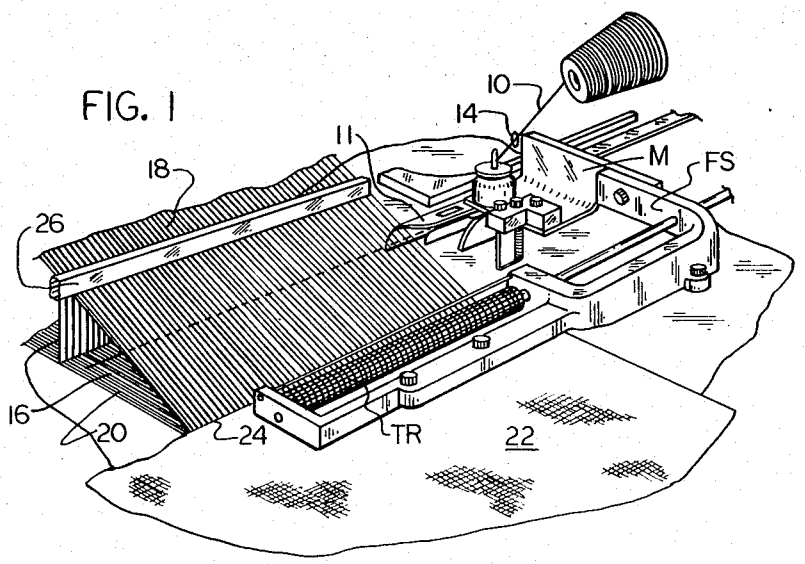
FIG. 1 is a perspective view, with parts broken away, of a fabric fell support having the weft yarn control mechanism attached thereto.
Figure 2A:
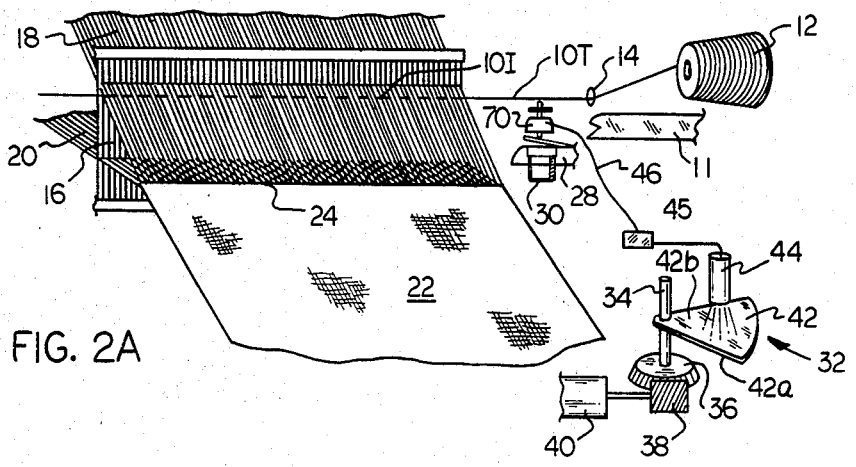
FIG. 2A is a schematic representation of the inventive concept illustrating a yarn having been introduced through the shed with the rapier retracted and the reed withdrawn in preparation for the beat-up operation.

Turning now to the drawings, and particularly to FIGS. 1, 2A, and 2B, there is illustrated the apparatus of the present invention in its intended environment. As shown in FIG. 1, the weft yarn control mechanism M of the present invention is attached to the right hand fell support FS of the loom. The fell support FS also supports the temple roll TR in engagement with the fabric 22 being formed by the operation of the loom. Again, the overall concept of the present invention is to control the trailing portion of an inserted yarn end between picks to both sever and reposition the trailing portion for the next pick utilizing a simplified, stationary control device.

Toward this end and with reference to FIG. 2A, a yarn end 10 from a yarn source 12 extends through an eyelet or guide 14. At the beginning of a pick, a yarn inserting member (sometimes called a carrier or rapier) 11 carries the leading end of the yarn end 10 through the shed 16 formed by upper and lower warp yarns 18,20 in front of a loom reed 26. The inserting carrier 11 traverses only half-way through the shed where it is met by a receiving carrier (not shown) which pulls the inserted portion 10I of yarn end 10 completely through shed 16. The right hand or inserting carrier 11 is then retracted to the position shown in FIG. 2A.

The loom reed 26 is then caused to move forwardly by conventional loom mechanisms to push or "beat-up" the yarn end 10 into the fabric 22 at the fabric fell 24 (see FIG. 2B). As the yarn end 10 moves forwardly by action of the reed 26 against the inserted portion 10I thereof, the trailing portion 10T is moved from the position shown in FIG. 2A to the position shown in FIG. 2B. The yarn control mechanism M of the present invention, which comprises a clamping device 28 and a yarn severing device 30, is placed in the aforesaid path of movement. Thus, as the trailing portion 10T moves forwardly, it first engages the curved guide surface 60 (FIGS. 3–5) of the clamping device 28 lifting the yarn to a level in proper vertical alignment with the carrier 11, so that as the carrier moves inwardly on the next pick, it engages and seats the trailing portion 10T as will be hereinafter described. Continued movement of the reed 26 brings the trailing portion 10T beneath the jaws of the clamping device 28, which are then closed to clamp or grip the trailing portion 10T thereunder.

Further movement of the reed 26 the innermost section of brings the trailing portion 10T into engagement with the yarn severing device 30. As illustrated in FIGS. 1–5, and in the preferred embodiment for synthetic yarns, the yarn severing device may be a hot wire. For natural or cellulosic fabric, the yarn severing device might be a more conventional knife or scissors arrangement that is activated by the movement of the reed 26 against a lever (not shown). A timing device 32 (e.g., a flag/proximity switch arrangement) activates the clamping device 28 to grip and release the trailing portion 10T at the proper time during the operative cycle of the loom.

When the loom reed 26 completes the beat-up operation, it returns to the position shown in FIG. 2A and the carrier 11 moves inwardly for the next pick. On its inward path, the carrier 11 picks up the trailing portion 10T which extends between the eyelet 14 and the gripping device 28 and properly seats the yarn therein. The timing device 32 is so constructed and arranged that when the seating is completed, the clamping device 28 is released, and the leading end of the yarn end 10 is carried through shed 16 for the next cycle. This completes a description of a single cycle of the yarn insertion.

The timing device 32 selected for use in the preferred embodiment is a flag/proximity switch type timer of a relatively conventional design in which an opaque flag or arcuate disc segment is rotated synchronously with the weft insertion cycle. See FIGS. 2A and 2B. Thus, for each cycle of weft insertion, the flag rotates once. During the rotation, the flag interrupts the signal from a photocell for a prescribed portion of the cycle to alternately activate and deactivate switch mechanism 45. Thus, the switch is caused to change its state in timed relation to the rotation of the flag.

In FIGS. 2A and 2B, shaft 34 includes a bevel gear 36 attached to the lower end thereof in meshing arrangement with a second bevel gear 38. The cam shaft 40 of the loom is operatively connected to bevel gear 38. The gear ratio between gears 36 and 38 is such that for every rotation of cam shaft 40, there is a one rotation of the upright shaft 34. An opaque flag or arcuate disc 42 is secured to shaft 34 and rotates therewith in the path of a photocell 44. When the leading edge 42*a* of flag 42 passes beneath photocell 44, the light emitted therefrom is interrupted and remains so until the trailing edge 42*b* of flag 42 passes thereunder. During this time proximity switch 45 is in a changed state from that which exists when the light rays emitted by photocell 44 are not interrupted. Thus, two types of signals are generated and passed through electrical line 46 to a solenoid 70 which operates clamping device 28 and will be hereinafter described. One signal indicates the time the solenoid 70 should be activated and the other signal indicates the time period that the solenoid should be deactivated. While the flag/proximity switch is described hereinabove, it should be apparent that other timing devices that operate solenoid 70 at appropriate times during each weaving cycle could be easily utilized.

Figure 3:
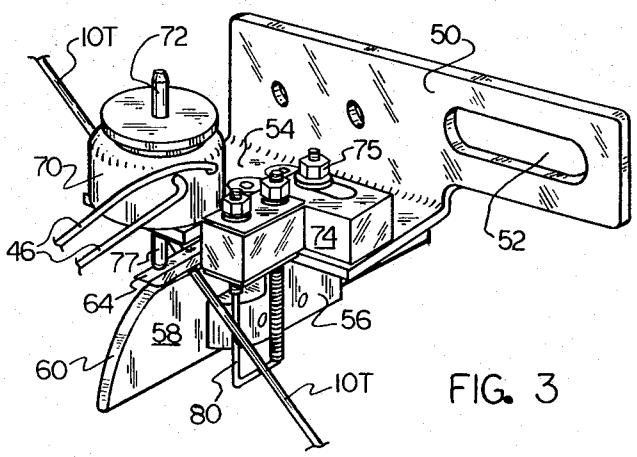
FIG. 3 is an enlarged perspective view illustrating the yarn guiding, clamping, and severing device of the present invention removed from the loom.
Figure 5:
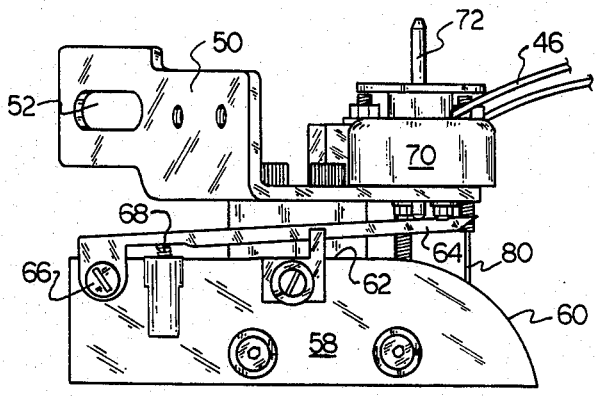
FIG. 5 is also an elevation view of the guide and clamp device, but looking from the rear side.
Figure 4:
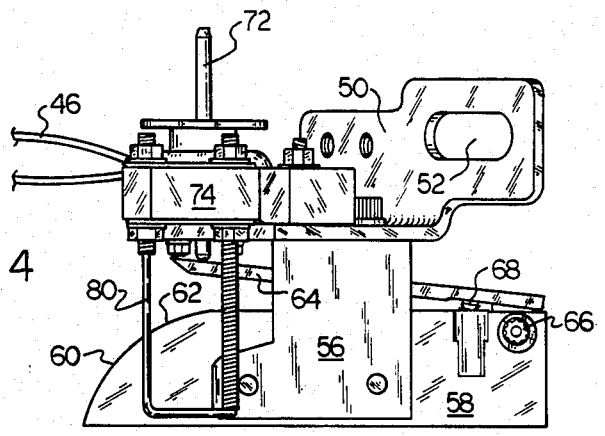
FIG. 4 is an elevation view of the guide and clamp device of FIG. 3 looking from the front side.

Turning now to FIGS. 3-5 there is shown an enlarged view of the clamping and severing apparatus 28,30 as utilized in connection with the present invention. In order to properly mount the clamping and severing devices 28,30 there is provided an angle bracket which includes an upstanding wall 50 having an elongated slot 52 therein for adjustably mounting said bracket to an upstanding wall of the existing right hand fell support FS on shuttleless looms. A horizontally extending shelf 54 extends from the lower edge of upstanding wall 50 and supports a depending first mounting bracket 56 to which the clamping device 28 is attached. The clamping device itself includes a vertically arranged bar or plate 58 having a curved leading edge 60 and a generally horizontal upper edge 62. Upper edge 62 forms the lower jaw of the clamping device. An upper jaw 64 is pivotally attached at the rear end thereof by a pivot means 66 to the rear end of upstanding bar 58. The upper jaw 64 is normally urged upwardly by a bias spring 68, which in turn is mounted in a well in plate 58. A solenoid 70 is mounted atop shelf 54 and includes a pin 72 extending therethrough into engagement with the front end of upper jaw 64. Pin 72 is caused to move up and down by the coil of solenoid 70 in response to activating or deactivating signals from proximity switch 45.

A second mounting block or bracket 74 is secured by a fastening member 75 through a corresponding opening in the horizontal plate or shelf 54 for mounting the vertically extending hot wire. The hot wire 80 is electrically connected to a source of current somewhere in the loom electrical system.

When assembled, as illustrated schematically in FIGS. 2A and 2B, the clamping device 28, which is formed of vertical plate 58 and the upper clamping jaw 64 is arranged to angularly extend into the path of and toward the point where the trailing end 10T begins its forwardly movement. Thus, soon after the trailing portion 10T of yarn 10 begins to move forwardly toward the fabric fell 24, the trailing portion 10T engages the nose 60 of plate 58 and is lifted upwardly into a position between jaws 62,64. At this elevation, the trailing portion 10T, which was previously released by the carrier 11 to a lower elevation as the yarn end 10 extends through the yarn shed, is raised to the proper level for engagement by the carrier or rapier 11 on the next pick. Further, the trailing portion 10T which remains after the inserted portion 10 is severed therefrom by the severing device 30 is gripped along a path extending between the gripping member 28 and the eyelet 14. This path is angular with respect to and intersects the inward path of the carrier as it begins its inward movement toward and through the yarn shed 16.

The sequence of events which occurs after a yarn end is inserted into the shed is that the reed 26 begins to move forwardly carrying the inserted portion of yarn 10 therewith, causing the trailing portion 10T to also move forwardly. As the trailing portion 10T engages the gripping device 28 it moves upwardly into a position between the jaws 62,64. At this time, the leading edge 42*a* of flag 42 passes beneath the photocell 44. As a result the solenoid 70 is activated to move upper jaw 64 into engagement with lower jaw 62 thus gripping the trailing portion 10T therebetween. As the reed 26 continues its forward movement, the short section of the trailing portion 10T which extends between the gripping member 28 and the edge of fabric fell 24 is caused to further move into engagement with the yarn severing device 30. The yarn is then severed at a time just before the beat-up operation is completed and after the trailing portion 10T has been gripped. The reed returns to its rearward position. The carrier 11 then moves inwardly grasping the trailing portion 10T which has been gripped between the gripping jaws 62,64 and extends to eyelet 14 across the path of the carrier 11. At the time the trailing portion 10T of yarn is properly seated in the carrier 11, the flag 42 is of such width that the trailing edge 42*b* passes the light beam from photocell 44 which signals the proximity switch 45 to release solenoid 70. The yarn 10 is then passed through the shed and the cycle is repeated.

While a preferred embodiment of the invention is described in detail hereinabove, it is apparent that various changes and modifications might be made without departing from the scope of the present invention which is set forth in the accompanying claims.

What is claimed is:

1. In a shuttleless loom of the type in which a weft yarn is repeatedly inserted by a weft yarn insertion device into the shed formed between upper and lower sets of warp yarns, a weft yarn control device mounted on the loom frame and stationary with respect to said loom reed for clamping and severing the trailing portion of the weft yarn during the operation in which the weft yarn is beaten longitudinally of the loom frame by the loom reed from a first path extending along the initial path of the weft yarn through the shed forwardly into a second path defined by the fabric fell, said weft yarn holding device further holding the trailing portion of the severed weft yarn in proper position for pick up during the next operation of the weft thread insertion means, said device comprising:

(a) guide means positioned rearwardly of the first path for initially maintaining the trailing portion of the weft yarn across the path of the weft yarn insertion device and along a path angling rearwardly and outwardly from the edge of said fabric fell as the weft yarn is beaten thereinto;

(b) a clamp means mounted on said loom frame alongside the shed between the first path and the fabric fell, stationary with respect to said loom reed, and in the path of said trailing weft yarn portion as it moves from said first path to said second path for receiving the trailing portion therein during the beat-up operation;

(c) severing means mounted on said loom frame stationary with respect to said loom reed, alongside the shed, and in the path of said trailing portion between said clamp means and said fabric fell for severing the trailing portion of the weft yarn after said clamp has been activated responsive to further movement of the trailing weft yarn portion from the first path to the second path;

(d) said clamp means, when activated, retaining said trailing portion of the weft yarn properly positioned in the path of the weft thread insertion device for the next pick up without any further movement of the stationary clamp means; and (e) timing means for activating and deactivating said clamp means in accordance with a preprogrammed sequence wherein said clamp is activated when said trailing weft yarn portion moves thereunder responsive to movement of said loom reed and is released when said trailing portion is seated in and under control of the weft thread insertion means for the ensuing pick.

2. The device according to claim 1 wherein said clamp includes a pair of clamping jaws and a guide surface for lifting said trailing portion of said guide yarn into position between said clamp jaws, said position between said clamping jaws further being the proper position for said trailing portion to be seated in said yarn insertion means during the next pick.

3. The device according to claim 1 wherein said severing means is a hot wire.

4. The device according to claim 1 wherein said timing means includes a solenoid operatively connected to one of the jaws of said clamping means and a flag/proximity switch for operating said solenoid, said flag being mounted on a shaft that rotates synchronously with the cam shaft of said loom, whereby said solenoid is activated for a prescribed period or time interval of each cycle of operation of said loom.

5. In a shuttleless loom a method for controlling the trailing portion of the weft yarn extending from the fabric fell to the yarn source during the beat-up operation of the loom reed and comprising the steps of:

(a) inserting a weft yarn into the shed formed by warp yarns by means of a weft yarn insertion device;

(b) beating the inserted weft yarn portion by the loom reed forwardly towards the fabric fell;

(c) during and responsive to the aforesaid forward movement of the reed, lifting the trailing portion of the weft yarn between the jaws of a clamping device in proper position for the next pick of the weft yarn insertion device;

(d) activating the jaws of said clamp in accordance with a prescribed timing sequence to clamp said trailing portion therebetween;

(e) after step (d) and prior to the time the weft yarn is beaten into the fabric fell, passing the trailing portion of the weft yarn into operative contact with a weft yarn severing device responsive to continued movement of the loom reed;

(f) maintaining the trailing portion of the weft yarn in gripped condition until the weft yarn insertion device begins its next movement toward the shed and releasing said clamping device responsive to said prescribed timing sequence at such time in said sequence that corresponds to the time when the trailing weft yarn portion is properly seated in the insertion device.

* * * * *